US006592687B1

(12) United States Patent
Lee et al.

(10) Patent No.: US 6,592,687 B1
(45) Date of Patent: Jul. 15, 2003

(54) ALUMINUM ALLOY AND ARTICLE CAST THEREFROM

(75) Inventors: Jonathan A. Lee, Madison, AL (US); Po-Shou Chen, Huntsville, AL (US)

(73) Assignee: The United States of America as represented by the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 10/196,389

(22) Filed: Jul. 11, 2002

Related U.S. Application Data

(60) Continuation-in-part of application No. 09/606,108, filed on Jun. 19, 2000, now abandoned, which is a continuation-in-part of application No. 09/218,675, filed on Dec. 22, 1998, now abandoned, which is a division of application No. 09/152,469, filed on Sep. 8, 1998, now abandoned.

(51) Int. Cl.[7] ..... C22C 21/04

(52) U.S. Cl. ..... 148/418; 420/535; 420/544; 420/551; 428/614

(58) Field of Search ..... 420/535, 544, 420/551; 148/439, 418; 428/614

(56) References Cited

U.S. PATENT DOCUMENTS 4,648,918 A * 3/1987 Asano et al. ..... 148/439

FOREIGN PATENT DOCUMENTS

JP 04105787 A * 4/1992 ..... B23K/35/28
SU 1836476 A3 * 8/1993 ..... C22C/21/04

* cited by examiner

*Primary Examiner*—George Wyszomierski
*Assistant Examiner*—Janelle Combs Morillo
(74) *Attorney, Agent, or Firm*—James J. McGroary; George F. Helfrich

(57) ABSTRACT

A cast article from an aluminum alloy, which has improved mechanical properties at elevated temperatures, has the following composition in weight percent: Silicon 14–25.0, Copper 5.5–8.0, Iron 0.05–1.2, Magnesium 0.5–1.5, Nickel 0.05–0.9, Manganese 0.05–1.0, Titanium 0.05–1.2, Zirconium 0.05–1.2, Vanadium 0.05–1.2, Zinc 0.05–0.9, Phosphorus 0.001–0.1, and the balance is Aluminum, wherein the silicon-to-magnesium ratio is 10–25, and the copper-to-magnesium ratio is 4–15. The aluminum alloy contains a simultaneous dispersion of three types of $Al_3X$ compound particles (X=Ti, V, Zr) having a $L1_2$ crystal structure, and their lattice parameters are coherent to the aluminum matrix lattice. A process for producing this cast article is also disclosed, as well as a metal matrix composite, which includes the aluminum alloy serving as a matrix and containing up to about 60% by volume of a secondary filler material.

10 Claims, 4 Drawing Sheets

ALUMINUM ALLOY AND ARTICLE CAST THEREFROM

CROSS-REFERENCE TO RELATED APPLICATIONS

This application is a continuation-in-part of application Ser. No. 09/606,108, filed Jun. 19, 2000 abandoned; which is a continuation-in-part of application Ser. No. 09/218,675, filed Dec. 22, 1998, and now abandoned; which is a division of application Ser. No. 09/152,469, filed Sep. 8, 1998, and now abandoned.

ORIGIN OF THE INVENTION

The invention described herein was made in the performance of work under a NASA contract and by an employee of the United States Government. It is subject to the provisions of Public Law 96-517 (35 U.S.C. §202), and may be manufactured and used by or for the Government for governmental purposes without the payment of any royalties thereon or therefor.

BACKGROUND OF THE INVENTION

1. Field of The Invention

This invention relates generally to aluminum-silicon (Al—Si) alloys. It relates particularly to a high strength Al—Si based alloy suitable for high temperature applications for cast components such as pistons, cylinder heads, cylinder liners, connecting rods, turbo chargers, impellers, actuators, brake calipers and brake rotors.

2. Description of the Related Art

Al—Si alloys are most versatile materials, comprising 85% to 90% of the total aluminum cast parts produced for the automotive industry. Depending on the Si concentration in weight percent (wt. %), the Al—Si alloy systems fall into three major categories: hypoeutectic (<12% Si), eutectic (12–13% Si) and hypereutectic (14–25% Si). However, most prior alloys are not suitable for high temperature applications because their mechanical properties, such as tensile strength and fatigue strength, are not as high as desired in the temperature range of 500° F.–700° F. To date, many of the Al—Si cast alloys are intended for applications at temperatures of no higher than about 450° F. Above this temperature, the major alloy strengthening phases such as the θ' ($Al_2Cu$) and S' ($Al_2CuMg$) phase will become unstable, rapidly coarsen and dissolve, resulting in an alloy having an undesirable microstructure for high temperature applications. Such an alloy has little or no practical application at elevated temperatures because, when the θ' and S' become unstable, the alloy lacks the lattice coherency between the aluminum solid solution lattice and the strengthening particles lattice parameters. A large mismatch in lattice coherency contributes to an undesirable microstructure that can not maintain excellent mechanical properties at elevated temperatures.

One approach taken by the prior art is to use fiber or particulate reinforcements to increase the strength of Al—Si alloys. This approach is known as the aluminum Metal Matrix Composites (MMC) technology. For example, U.S. Pat. No. 5,620,791 relates to an MMC comprising an Al—Si based alloy with an embedded a ceramic filler material to form a brake rotor for high temperature applications. An attempt to improve the high temperature strengths of Al—Si alloys was also carried out by R. Bowles, who has used ceramic fibers to improve tensile strength of an Al—Si 332.0 alloy, in a paper entitled, "Metal Matrix Composites Aid Piston Manufacture," *Manufacturing Engineering*, May 1987. Another attempt suggested by A. Shakesheff was to use ceramic particulate for reinforcing Al—Si alloy, as described in "Elevated Temperature Performance of Particulate Reinforced Aluminum Alloys," *Materials Science Forum*, Vol. 217–222, pp. 1133–1138 (1996). Cast aluminum MMC for pistons has been described by P. Rohatgi in a paper entitled, "Cast Aluminum Matrix Composites for Automotive Applications," *Journal of Metals*, April 1991. It is noted that the strength for most particulate reinforced MMC materials, manufactured from an Al—Si alloy, are still inferior for high temperature applications because the major θ' and S' strengthening phases are unstable, rapidly coarsen and dissolve at high temperatures.

Another approach taken by the prior art is the use of the Ceramic Matrix Composites (CMC) technology. For example, W. Kowbel has described the use of non-metallic carbon-carbon material for making pistons to operate at high temperatures in a paper titled, "Application of Net-Shape Molded Carbon-Carbon Composites in IC engines," *Journal of Advanced Materials*, July 1996. Unfortunately, manufacturing costs employing these MMC and CMC technologies are substantially higher than those using conventional Al—Si casting, which has hampered their ability to be priced competitively with Al—Si alloys in mass production for high temperature internal combustion engine parts and brake applications.

It is accordingly a primary object of the present invention to obviate the disadvantages of the prior art technologies.

SUMMARY OF THE INVENTION

According to the present invention, an Al—Si alloy containing dispersion of particles having $L1_2$ crystal structure in the aluminum matrix is presented. The alloy is processed using low cost casting techniques such as permanent mold, sand casting or die casting.

The alloy of the present invention maintains a much higher strength at elevated temperatures (500° F. and above) than other prior art alloys, due to a unique chemistry and microstructure formulation. The methods for strengthening the alloy in the present invention include: 1) Maximizing the formation of major strengthening θ' and S' phase in the alloy, with chemical composition given as $Al_2Cu$, $Al_2CuMg$, respectively. 2) Stabilizing the strengthening phases at elevated temperatures by controlling the Cu/Mg ratio and by the simultaneous addition of Titanium (Ti), Vanadium (V) and Zirconium (Zr) elements. 3) Forming $A1_3X$ (X=Ti, V, Zr) compounds with $L1_2$ crystal structures for additional strengthening mechanisms at elevated temperatures.

In the present invention, key alloying elements of Ti, V and Zr are added to the Al—Si alloy to modify the lattice parameter of the aluminum matrix by forming compounds of the type $Al_3X$ having $L1_2$ crystal structures (X=Ti, V and Zr). In order to maintain high degrees of strength at high temperatures, both the aluminum solid solution matrix and the particles of $Al_3X$ compounds should have similar face-centered-cubic (FCC) crystal structures, and will be coherent because their respective lattice parameters and dimensions are closely matched. When the condition of substantial coherency for the lattice is obtained, these dispersion particles are highly stable, which results in high mechanical properties for the alloy during long exposures at elevated temperatures.

In addition to the alloy composition and microstructure, a unique heat treatment schedule is provided in order to optimize the performance for the alloy strengthening mechanisms and phases formation within the alloy. The advantages of the present invention will become apparent as the description thereof proceeds.

DETAILED DESCRIPTION OF THE INVENTION

The present invention includes detailed compositional, microstructure and processing aspects through conventional casting processes. The Al—Si alloy of the present invention is marked by an ability to perform in cast form, which is suitable for elevated temperature applications. It is comprised of the following elements, in weight percent:

| | |
|---|---|
| Silicon | 14.0–25.0 |
| Copper | 5.5–8.0 |
| Iron | 0.05–1.2 |
| Magnesium | 0.5–1.5 |
| Nickel | 0.05–0.9 |
| Manganese | 0.05–1.0 |
| Titanium | 0.05–1.2 |
| Zirconium | 0.05–1.2 |
| Vanadium | 0.05–1.2 |
| Zinc | 0.05–0.9 |
| Phosphorus | 0.001–0.1 |
| Aluminum | Balance |

Silicon gives the alloy a high elastic modulus and low thermal coefficient of expansion. The addition of silicon is essential in order to improve the fluidity of the molten aluminum to enhance the castability of the Al—Si alloy according to the present invention. At a silicon level of at least 14%, the alloy exhibits excellent surface hardness and wear resistance properties.

Copper co-exists with magnesium and forms a solid solution in the aluminum matrix to give the alloy age-hardening properties, thereby improving the high temperature strength. Copper also forms the θ' phase compound ($Al_2Cu$), and is the most potent strengthening element in this new alloy. The enhanced high strength at high temperatures is affected if the copper wt % level is not adhered to. Moreover, the alloy strength can only be maximized effectively by the simultaneous formation for both of the θ' ($Al_2Cu$) and S' ($Al_2CuMg$) metallic compounds, using proper addition of magnesium into the alloy relative to the elements of copper and silicon. Experimentally, it is found that an alloy with a significantly higher level of magnesium will form mostly S' phase with insufficient amount of θ' phase. On the other hand, an alloy with a lower level of magnesium contains mostly θ' phase with insufficient amount of S' phase.

Figure 4:
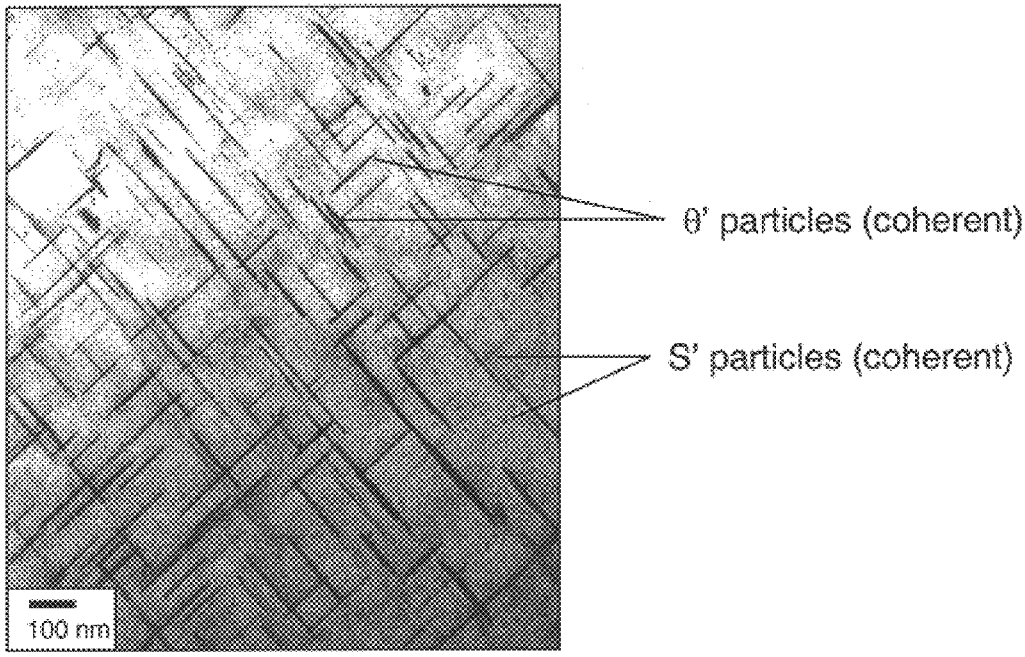
FIG. 4 is an electron micrograph showing the size, shape and the amount of the alloy strengthening θ' and S' coherent phases for the alloy of this invention as observed at room temperature.

To maximize the formation of both the θ' and S' phases, the alloy composition was specifically formulated with copper-to-magnesium (Cu/Mg) ratios ranging from 4 to 15, with a minimum value for magnesium of no less than 0.5 wt %. In addition to the Cu/Mg ratio, the silicon-to-magnesium (Si/Mg) ratio is kept in the range of 10 to 25, preferably 14 to 20, to properly form the $Mg_2Si$ metallic compound as a minor strengthening phase, in addition to the primary θ' and S' phases. Moreover, the unique Cu:Mg ratio greatly enhances the chemical reactions among aluminum (Al), copper (Cu) and magnesium (Mg) atoms. Such chemical reactions permit precipitation of a higher volume fraction of the strengthening phases θ' and S' within the alloy. FIG. 4 is an elect of the alloy strengthening θ' and S' coherent phases for the alloy of this invention as observed room temperature. The combination of high volume fraction and coherent θ of the present invention, as shown in FIG. 4, lead to exceptional tensile strength and microstructure stability at elevated temperatures. The average particle size of the θ phase is less than 100 nm in diameter at room temperature.

Figure 1:
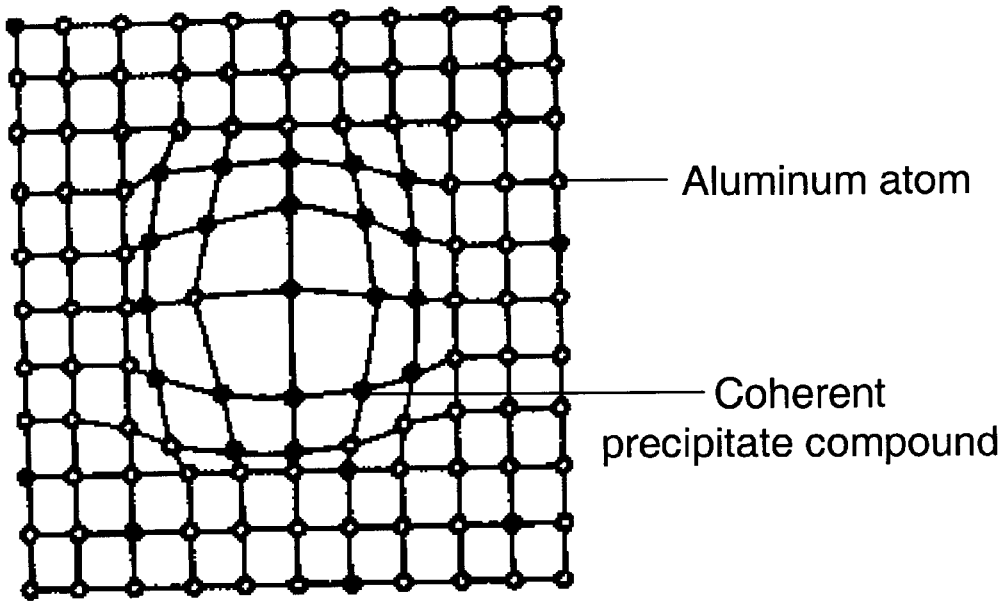
FIG. 1 is a diagram illustrating a coherent particle that has similar lattice parameters and crystal structure relationship with the surrounding aluminum matrix atoms.

Titanium, Vanadium and Zirconium are added to the Al—Si alloy to modify the lattice parameter of the aluminum matrix by forming compounds of the type $Al_3X$ having $L1_2$ crystal structures (X=Ti, V, Zr). In order to maintain high degrees of strength at temperatures very near to their alloy melting point, both the aluminum solid solution matrix and the particles of $Al_3X$ compounds have similar face-centered-cubic (FCC) crystal structures, and are coherent because their respective lattice parameters and dimensions are closely matched. For example, FIG. 1 is a diagram illustrating a coherent particle that has similar lattice parameters and crystal structure relationship with the surrounding aluminum matrix atoms. The compounds of the type $Al_3X$ (X=Ti, V, Zr) particles also act as nuclei for grain size refinement upon the molten aluminum alloy being solidified from the casting process. Titanium and vanadium also function as dispersion strengthening agents, having the $L1_2$ lattice structure similar to the aluminum solid solution, in order to improve the high temperature mechanical properties. Zirconium also forms a solid solution in the matrix to a small amount, thus enhancing the formation of GP (Guinier-Preston) zones, which are the Cu—Mg rich regions, and the θ' phase in the Al—Cu—Mg system to improve the age-hardening properties. Although the stable θ' ($Al_2Cu$) is the primary strengthening phase at elevated temperatures, the importance of having Ti, V, and Zr elements in the alloy cannot be discounted. Upon the molten alloy being solidified from the casting process, these elements react with aluminum to form $Al_3X$ (X=Ti, V, Zr) compounds that precipitate as nucleation sites for effective grain size refinement. Moreover, $Al_3X$ (X=Ti, V, Zr) precipitates also function as dispersion strengthening agents, effectively blocking the movement of dislocations and enhance the high temperature mechanical properties. High temperature strength characteristics of the alloy of this invention are detrimentally affected if Ti, V, and Zr are not used simultaneously in the proper amount for forming $Al_3$(Ti, V, Zr) precipitates.

Figure 2:
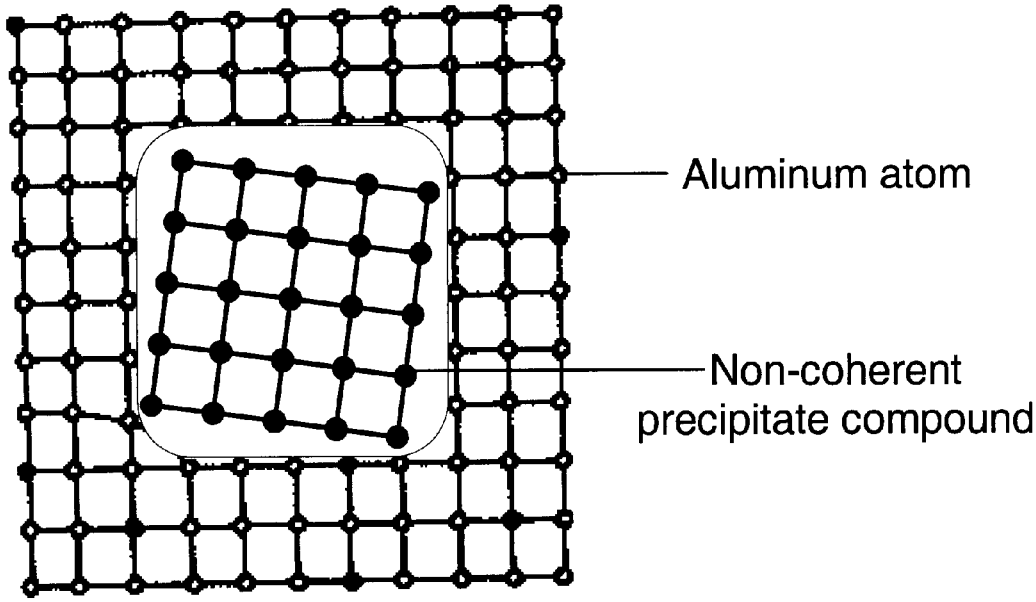
FIG. 2 is a diagram illustrating a non-coherent particle having no crystal structural relationship with the surrounding aluminum matrix atoms. Such an alloy has little or no practical application at elevated temperatures.
Figure 3:
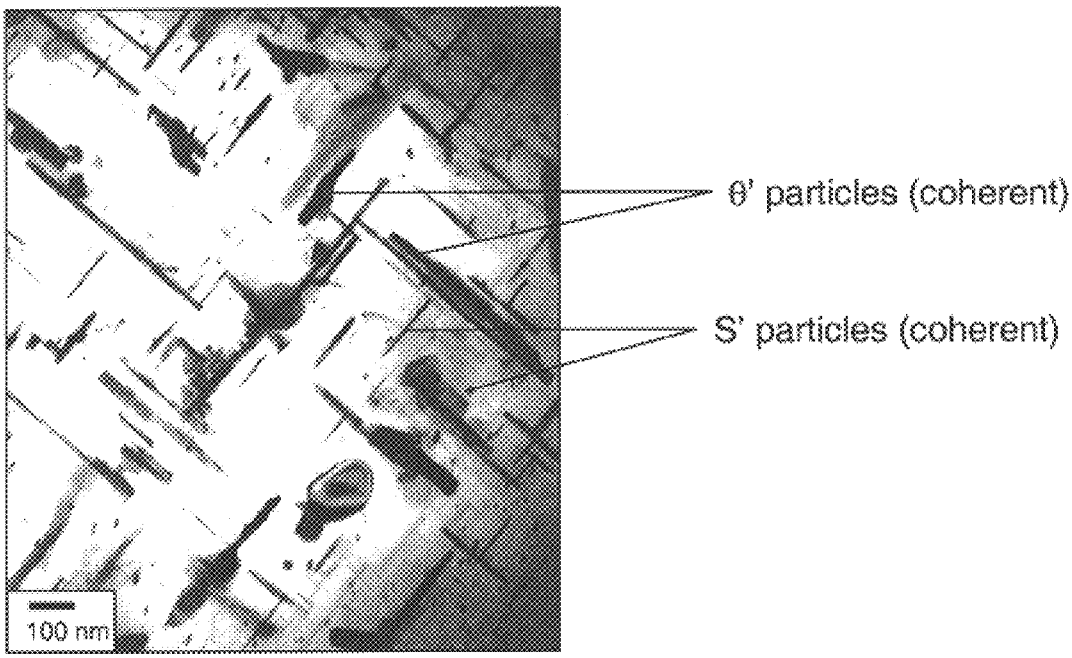
FIG. 3 is an electron micrograph showing the size and shape of the alloy θ' and S' coherent phases for prior art alloys as observed at room temperature.
Figure 5:
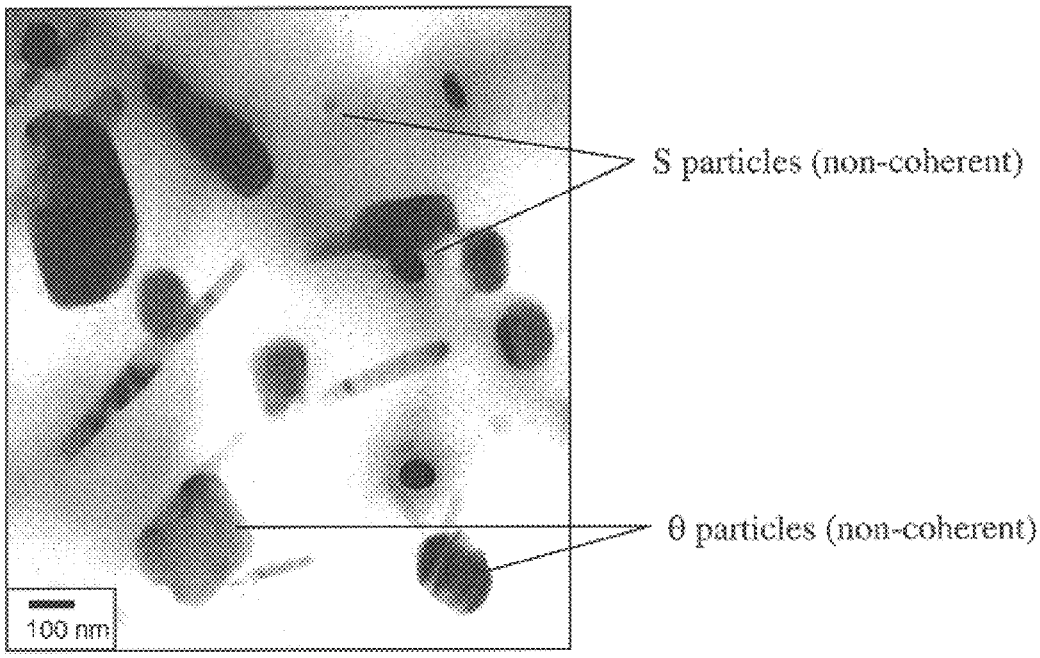
FIG. 5 is an electron micrograph showing the transformation of θ and S' coherent phase, as observed in FIG. 3, into the undesirable θ and S noncoherent phases for the prior art alloys after they have been exposed to 600° F. for 100 hours. The θ and S phases are noncoherent because they become unstable rapidly coarsen and dissolve, resulting in an alloy which has an undesirable microstructure for high temperature applications.
Figure 6:
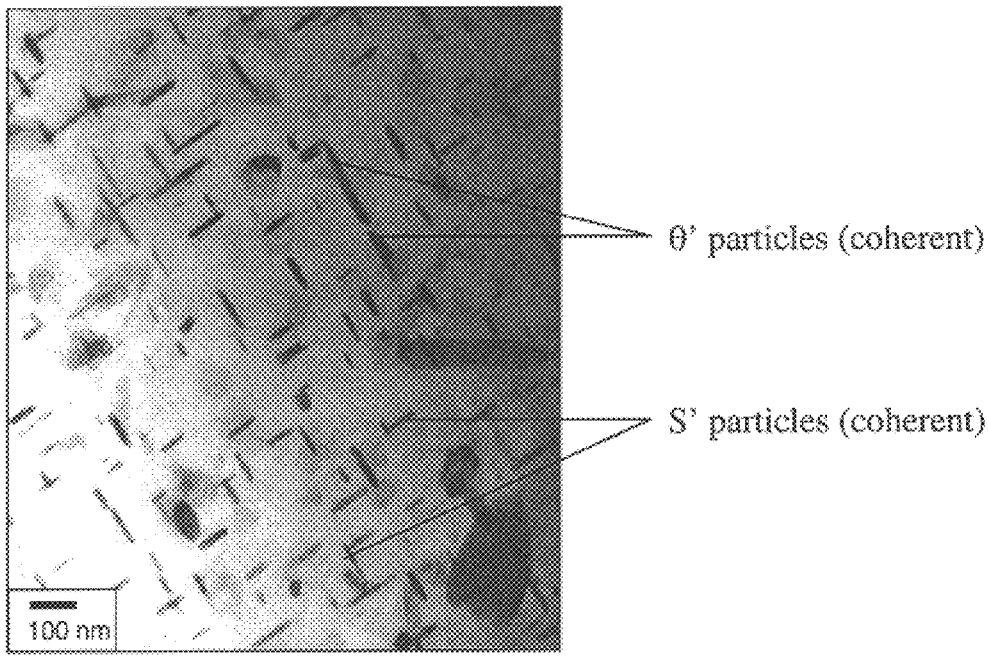
FIG. 6 is an electron micrograph showing the highly stable θ' and S' coherent phases for the alloy of this invention after it has been exposed to 600° F. for 100 hours. Unlike the prior art, the alloy of this invention still retains the θ' and S' coherent phases, which are a desirable microstructure for high temperature applications.

FIG. 6 is an electron micrograph showing the highly stable θ' and S' coherent phases for the alloy of this invention after it has been exposed to temperatures of 600° F. for 100 hours. Unlike alloys of the prior arts, the alloy of this invention still retains the θ' and S' coherent phases, which are a desirable microstructure for high temperature applications. Because of the unique Cu/Mg ratio for the alloy of this invention, θ' still maintains its coherency to the matrix even after it has been soaked at 600° F. for 100 hours. During soaking at 600° F., θ' grew slightly in thickness but it did not coarsen, and still maintained a small diameter (i.e., less than 60 nm) and semi-coherency to the matrix, which is critical for achieving high strength at elevated temperatures. The coherency between Al matrix and θ' phase creates a definite relationship between the θ' precipitate's and the matrix's crystal structure. As a result, the movement of dislocation is impeded at the interface of θ' phase and the matrix, and significant strengthening occurs. FIG. 5 is an electron micrograph showing the transformation of the θ' and S' coherent phases, as observed in FIG. 3, into the undesirable θ and S noncoherent phases for the prior art alloys after they have been exposed to 600° F. for 100 hours. In FIG. 5, the θ' phase from other prior art alloys coarsens significantly and loses its coherency at elevated temperatures, thus resulting in a drastic loss in strength for elevated temperature applications. FIG. 2 is a diagram illustrating a non-coherent particle having no crystal structural relationship with the surrounding aluminum matrix atoms. Such an alloy has little or no practical application at elevated temperatures.

Nickel improves the alloy tensile strength at elevated temperatures by reacting with aluminum to form the $Al_3Ni_2$ and $Al_3Ni$ compounds, which are stable metallurgical phases to resist the degradation effects from the long-term exposure to high temperature environments.

In order for these strengthening mechanisms to function properly within the alloy, the casting article must have a unique combination of chemical composition and heat treatment history. The heat treatment is specifically designed to maximize the performance of the unique chemical composition. As discussed above, the exceptional performance of the alloy of the present invention is achieved by the combination of the following strengthening mechanisms through a unique heat treatment schedule. The heat treatment for the alloy of this invention was developed to maximize the formation of θ' and S' phases in the alloy (high volume fraction), to stabilize θ' phase at elevated temperature by controlling Cu/Mg ratio, and to maximize the formation of $Al_3$ (Ti, V, Zr) compounds for additional strengthening with mechanisms simultaneous addition of Ti, V, and Zr.

Maximum high temperature strength has been attained by the present invention when using a T5 heat treatment consisting of aging at 400 to 500° F. for four to twelve hours. The heat treatment schedule complements the unique alloy composition to form a maximum amount of precipitates with uniform distribution and optimum particle size. Thus, the present alloy has properties that are superior to the prior art alloys, because of a unique combination of chemical composition and heat treatment processing.

The alloy of the present invention is processed using conventional gravity casting in the temperature range of about 1325° F. to 1450° F., without the aid of external pressure, to achieve dramatic improvement in tensile strengths at 500° F. to 700° F. However, it is anticipated that further improvement of tensile strengths will be obtained when the alloy of the present invention is cast using pressure casting techniques such as squeeze casting.

An article, such as a cylinder head, engine block or a piston, is cast from the alloy, and the cast article is then solutionized at a temperature of 900° F. to 1000° F. for fifteen minutes to four hours. The purpose of the solutionizing step is to dissolve unwanted precipitates and reduce any segregation present in the alloy. For applications at temperatures from 500° F. to 700° F. the solutioning treatment may not be required.

After solutionizing, the cast article is advantageously quenched in a quenching medium, at a temperature within the range of 120° F. to 300° F., most preferably 170° F. to 250° F. The most preferred quenching medium is water. After quenching, the cast article is aged at a temperature of 425° F. to 485° F. for six to 12 hours.

Figure 7:
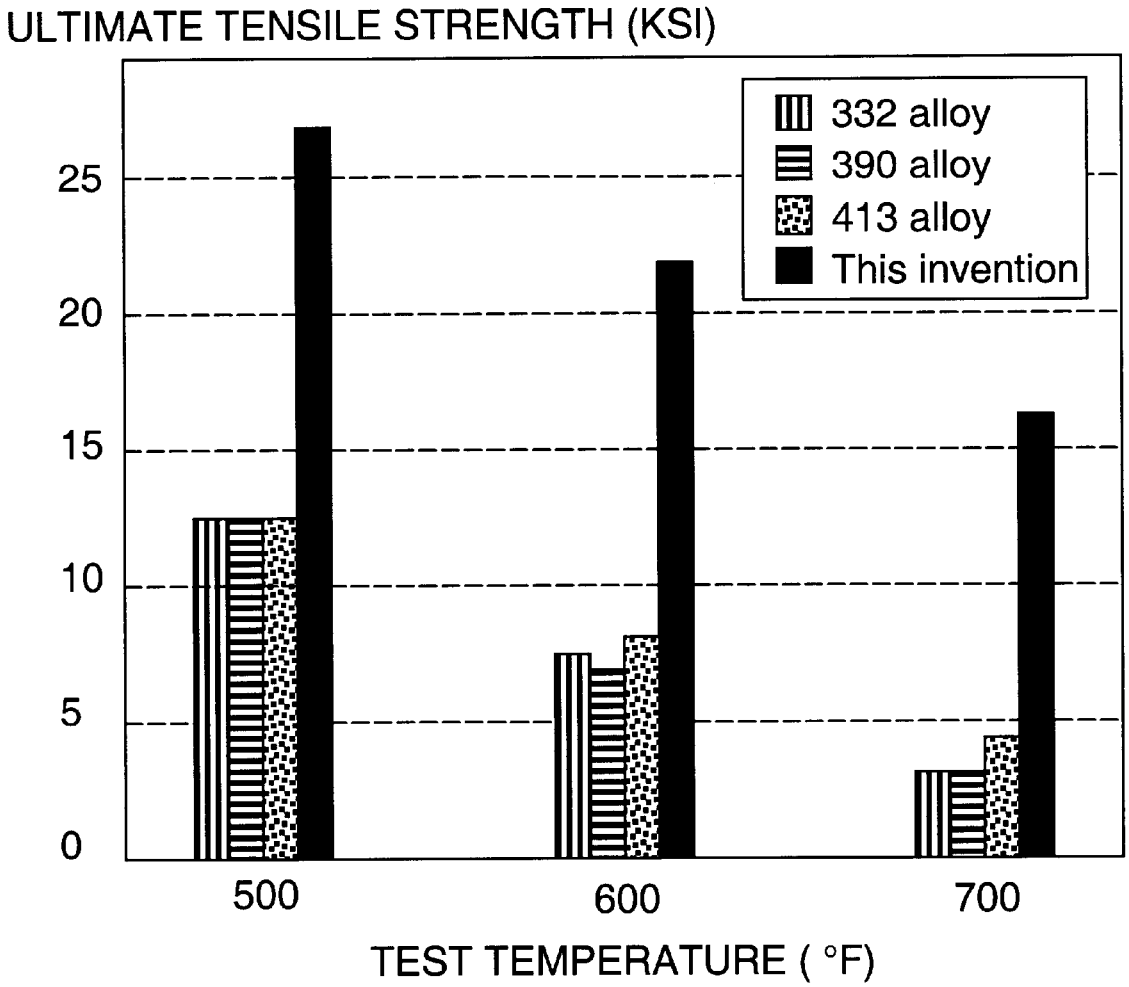
FIG. 7 is a chart showing a comparison of an alloy according to the present invention with three well-known prior art alloys (332, 390 and 413). The chart compares the ultimate tensile strengths (tested at 500° F., 600° F. and 700° F.), after exposure of all test specimens to a temperature of 500° F., 600° F., 700°F. for 100 hours, respectively.

FIG. 7 is a chart which illustrates the dramatic improvement in the ultimate tensile strength (UTS) at elevated temperatures for a cast article produced according to the present invention. This table compares the tensile strengths of articles produced according to this invention, with articles prepared from two well known hypo-eutectic (332.0), and eutectic (413.0), and hyper-eutectic (390.0) alloys, after articles cast from these alloys had been exposed to 500° F., 600° F. and 700° F., respectively, for 100 hours. The cast articles were then tested at elevated temperatures of 500° F., 600° F., 700° F., respectively. It is noted that the tensile strength of articles prepared according to this invention is more than three times that of those prepared from the conventional eutectic 413.0 alloy, and more than four times that of those prepared from hypo-eutectic 332.0 alloy and the hyper-eutectic 390.0 alloy, when tested at 700° F.

The alloy of the present invention may be used in a bulk alloy form. It may also be used as an alloy matrix for the making of aluminum metal matrix composites (MMC). Such composites comprise the aluminum alloy of the present invention as a matrix containing a filler material, which is in the form of particles, whiskers, chopped fibers and continuous fibers. One of the most popular ways to produce an MMC is to mechanically mix and stir various ceramic materials in the form of small particles or whiskers into a molten aluminum alloy. This process has been called a compo-casting or stir-casting of metal composite. In stir-casting techniques, the approach involves mechanical mixing and stirring of the filler material into a molten metal bath. The equipment usually consists of a heated crucible containing molten aluminum alloy, with an electric motor that drives a paddle-style mixing impeller, that is submerged in the molten metal. The filler material is poured slowly into the crucible above the melt surface and at a controlled rate, to ensure smooth and continuous feed. The temperature is usually maintained below the liquidus temperature to keep the aluminum alloy in a semi-solid condition in order to enhance the mixing uniformity of the filler material.

As the mixing impeller rotates at moderate speeds, it generates a vortex that draws the reinforcement particles into the melt from the surface. The impeller is designed to create a high level of shear force, which helps to remove the adsorbed gases from the surface of the particles. The high shear also engulfs the particle in- molten aluminum alloy, which promotes particle wetting in order to enhance the homogeneous distribution of the filler material within the MMC.

The filler materials in the metal composite should not be confused with the $Al_3X$ (X=Ti, V, Zr) particles with a diameter typically less than 100 nanometers (nm) in size. The filler materials or reinforcement materials added into the aluminum MMC usually have minimum dimensions which are much greater than 500 nm, typically in the range of 1 to 20 microns.

Suitable reinforcement materials for making aluminum metal matrix composite include common materials such as Silicon Carbide (SiC), Aluminum Oxide ($Al_2O_3$), Boron Carbide ($B_4C$), Yttrium Oxide ($Y_2O_3$), beryllium, graphite, diamond particles and mixtures thereof. These reinforcement materials are present in volume fractions up to about 60% by volume, and more preferably 5–35% by volume.

The present invention has been specified in detail with respect to certain preferred embodiments thereof. It is understood that variations and modifications in this detail may be effected without departing from the spirit and scope of the present invention, as defined in the hereto-appended claims.

We claim:

1. A cast article from an aluminum alloy, which has improved mechanical properties at elevated temperatures, the cast article having the following composition in weight percent:

| | |
|---|---|
| Silicon | 14–25.0 |
| Copper | 5.5–8.0 |
| Iron | 0.05–1.2 |
| Magnesium | 0.5–1.5 |
| Nickel | 0.05–0.9 |
| Manganese | 0.05–1.0 |
| Titanium | 0.05–1.2 |
| Zirconium | 0.05–1.2 |
| Vanadium | 0.05–1.2 |
| Zinc | 0.05–0.9 |
| Phosphorus | 0.001–0.1 |
| Aluminum | Balance |

wherein the silicon-to-magnesium (Si/Mg) ratio is 10–25, and the copper-to-magnesium (Cu/Mg) ratio is 4–15.

2. A cast article as in claim 1, comprising an aluminum solid solution matrix containing a simultaneous dispersion of three types of $Al_3X$ compound particles (X=Ti, V, Zr) having a $L1_2$ crystal structure and lattice parameters which are coherent to the aluminum matrix lattice.

3. A cast article as in claim 2, wherein the aluminum solid solution matrix contains a simultaneous dispersion of three types of $Al_3X$ compound particles (X=Ti, V, Zr), whose average size is less than about 100 nm in diameter.

4. A cast article as in claim 2, wherein the aluminum solid solution matrix contains a simultaneous dispersion of two types of particles from θ' and S' phases, and wherein the average particle size of the θ' phase is less than 300 nm in diameter at room temperature.

5. A cast article as in claim 4, wherein the average size of the θ' particle phase is less than 250 nm after soaking at 600° F. for 100 hours.

6. A cast article as in claim 4, wherein the θ' phase remains semi-coherent to the matrix after soaking between 600° F. and 700° F. for 100 hours.

7. A metal matrix composite comprising an aluminum alloy having the following composition in weight percent:

| | |
|---|---|
| Silicon | 14–25.0 |
| Copper | 5.5–8.0 |
| Iron | 0.05–1.2 |
| Magnesium | 0.5–1.0 |
| Nickel | 0.05–0.9 |
| Manganese | 0.05–1.2 |
| Titanium | 0.05–1.2 |
| Zirconium | 0.05–1.2 |
| Vanadium | 0.05–1.2 |
| Zinc | 0.05–0.9 |
| Phosphorus | 0.001–0.1 |
| Aluminum | Balance; |

wherein the silicon-to-magnesium (Si/Mg) ratio is 10–25, and the copper-to-magnesium (Cu/Mg) ratio is 4–15; the aluminum alloy comprising $Al_3X$ (X=Ti, V, Zr) compound particles with $L1_2$ crystal structure in an aluminum solid solution, and the aluminum alloy serving as a matrix containing up to about 60% by volume of a secondary filler material having a geometry selected from the group consisting of particles, whiskers, chopped fibers or continuous fibers.

8. The metal matrix composite of claim 7, wherein the secondary filler material is selected from the group consisting of Silicon Carbide (SiC), Aluminum Oxide ($Al_2O_3$), Boron Carbide ($B_4C$), Yttrium Oxide ($Y_2O_3$), graphite, diamond particles, and is present in a volume fraction between 5% and 35% by volume.

9. An aluminum alloy having the following composition in weight percent:

| | |
|---|---|
| Silicon | 14–25.0 |
| Copper | 5.5–8.0 |
| Iron | 0.05–1.2 |
| Magnesium | 0.5–1.5 |
| Nickel | 0.05–0.9 |
| Manganese | 0.05–1.2 |
| Titanium | 0.05–1.2 |
| Zirconium | 0.05–1.2 |
| Vanadium | 0.05–1.2 |
| Zinc | 0.05–0.9 |
| Phosphorus | 0.001–0.1 |
| Aluminum | Balance |

wherein the silicon-to-magnesium (Si/Mg) ratio is 10–25, and the copper-to-magnesium (Cu/Mg) ratio is 4–15.

10. An aluminum alloy as in claim 9, comprising an aluminum solid solution matrix containing a simultaneous dispersion of three types of $Al_3X$ compound particles (X=Ti, V, Zr) having a $L1_2$ crystal structure and lattice parameters which are coherent to the aluminum matrix lattice.

* * * * *